US010179689B2

(12) United States Patent
Go

(10) Patent No.: US 10,179,689 B2
(45) Date of Patent: Jan. 15, 2019

(54) PILL BOX IN AUTOMATIC PILL DISPENSER

(71) Applicant: HON HAI PRECISION INDUSTRY CO., LTD., New Taipei (TW)

(72) Inventor: Bharata Go, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 49 days.

(21) Appl. No.: 15/239,839

(22) Filed: Aug. 18, 2016

(65) Prior Publication Data

US 2018/0029779 A1 Feb. 1, 2018

(30) Foreign Application Priority Data

Jul. 26, 2016 (CN) ..... 2016 1 0593611

(51) Int. Cl.

*B65D 83/04* (2006.01)
*A61J 1/03* (2006.01)
*A61J 7/00* (2006.01)
*A61J 7/04* (2006.01)

(52) U.S. Cl.

CPC ..... *B65D 83/0481* (2013.01); *A61J 1/03* (2013.01); *A61J 7/0076* (2013.01); *A61J 7/0084* (2013.01); *A61J 7/04* (2013.01)

(58) Field of Classification Search

CPC ..... B65D 83/0481; A61J 1/03; A61J 7/0076; A61J 7/04; A61J 7/0084

USPC ..... 221/268

See application file for complete search history.

(56) References Cited

U.S. PATENT DOCUMENTS 1,237,919 A * 8/1917 Linkiewicz ..... G07F 17/14 194/295
2,532,698 A * 12/1950 Corkins ..... G01F 11/24 141/104
2,943,730 A * 7/1960 Tregilgas ..... B65D 83/0454 116/308
3,871,551 A * 3/1975 Bender ..... A61J 7/04 116/308
5,104,000 A * 4/1992 Goff ..... B65H 3/02 221/191
5,755,357 A * 5/1998 Orkin ..... A61J 7/0084 221/120

(Continued)

FOREIGN PATENT DOCUMENTS

JP 09030501 A * 2/1997
JP 2007238181 A * 9/2007

*Primary Examiner* — Rakesh Kumar
(74) *Attorney, Agent, or Firm* — ScienBiziP, P.C.

(57) ABSTRACT

A pill box which can be loaded by user with pills and which can dispense a particular desired pill or pills when the user presses or repeatedly presses a button of the pill box. The pill box includes a case defining a picking opening, a rotating member rotatably mounted in the case, and a thumb-operated pressing structure. The rotating member includes a ratchet wheel and a plurality of pill grips each containing a pill or pills. The pressing structure includes a sliding member slidably mounted to the case and a pawl abutting the ratchet wheel. The sliding member is slidable relative to the case and the pawl moves the ratchet wheel one click per thumbpress to rotate the ratchet wheel to align one of the plurality of pill grips with the picking opening for taking out the pill or pills.

18 Claims, 10 Drawing Sheets

(56) References Cited

U.S. PATENT DOCUMENTS

| | | | | |
|---|---|---|---|---|
| 5,915,589 | A * | 6/1999 | Lim | A61J 7/0481 221/13 |
| 7,108,153 | B2 * | 9/2006 | Wood | A61J 7/0076 221/105 |
| 7,775,205 | B2 * | 8/2010 | Edgerley | A61M 15/0045 128/200.14 |
| 7,896,192 | B2 * | 3/2011 | Conley | A61J 7/0472 221/15 |
| 7,917,246 | B2 * | 3/2011 | Handfield | A61J 7/0084 700/240 |
| 8,066,123 | B2 * | 11/2011 | Gelardi | B65D 83/04 206/1.5 |
| 8,327,847 | B2 * | 12/2012 | Scarrott | A61M 15/009 116/307 |
| 8,578,934 | B2 * | 11/2013 | Morton | A61M 15/0065 128/205.23 |
| 9,150,345 | B2 * | 10/2015 | Thongjitti | B65D 83/0016 |
| 9,174,775 | B2 * | 11/2015 | Foshee | A61J 7/0076 |
| 2002/0088817 | A1 * | 7/2002 | Bell-Greenstreet | A61J 7/0481 221/76 |
| 2011/0172812 | A1 * | 7/2011 | Joslyn | A61J 7/0076 700/232 |
| 2012/0152972 | A1 * | 6/2012 | Joslyn | A61J 7/0076 221/3 |
| 2016/0081883 | A1 * | 3/2016 | Saltsov | A61J 7/0084 221/2 |
| 2016/0120756 | A1 * | 5/2016 | Nazginov | A61J 7/04 116/201 |

* cited by examiner

PILL BOX IN AUTOMATIC PILL DISPENSER

FIELD

The subject matter herein generally relates to pill box in an automatic pill dispenser.

BACKGROUND

A pill box includes a plurality of receiving grids each configured to receive one type of pill, convenient for identifying and taking the pills. The pill box needs to be opened to take out pills.

BRIEF DESCRIPTION OF THE DRAWINGS

Implementations of the present technology will now be described, by way of example only, with reference to the attached figures.

DETAILED DESCRIPTION

Figure 1:
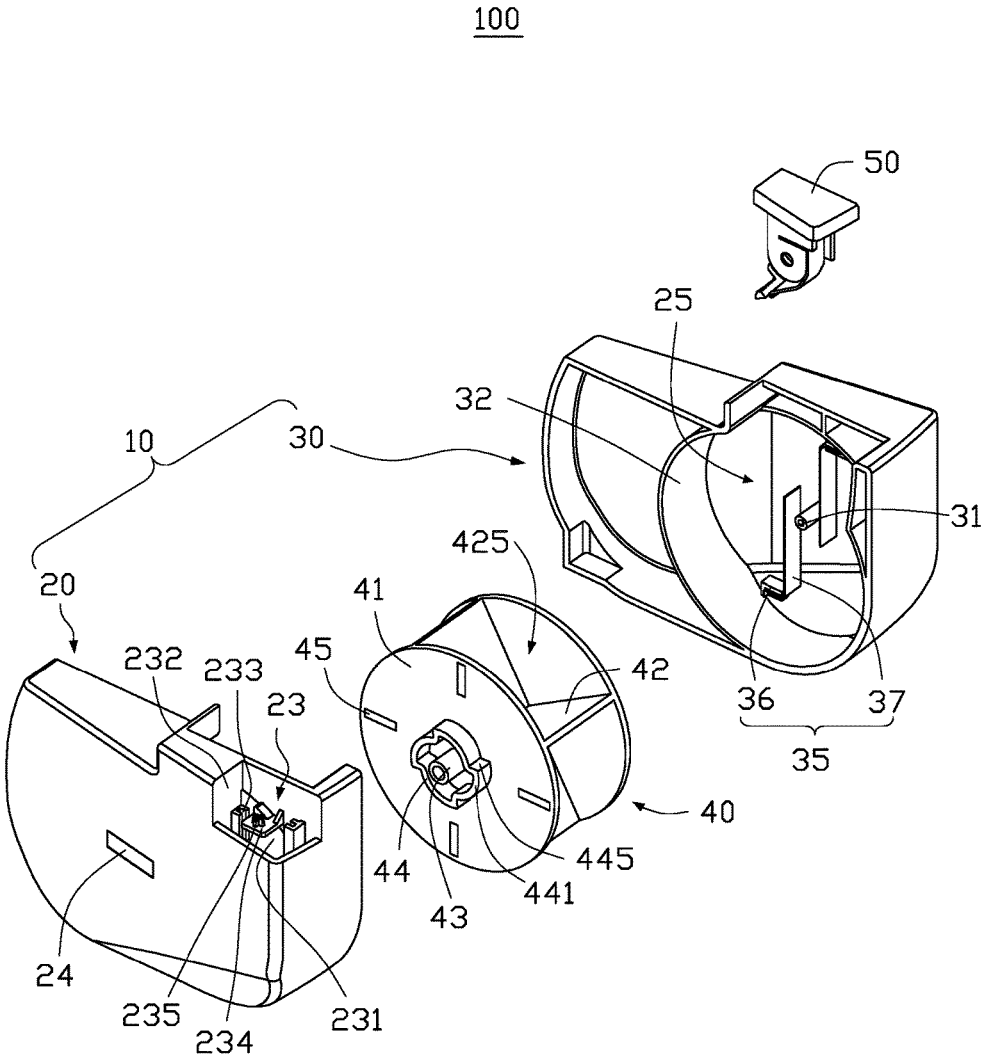
FIG. 1 is an exploded, isometric view of one embodiment of a pill box.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

FIG. 1 illustrates a pill box 100 in an embodiment. The pill box 100 is configured to receive a plurality of pills and can include a case 10, a rotating member 40 rotatably mounted in the case 10, and a pressing structure 50 slideably mounted to the case 10. In at least one embodiment, the pill box 100 is used in an automatic pill dispenser.

Figure 2:
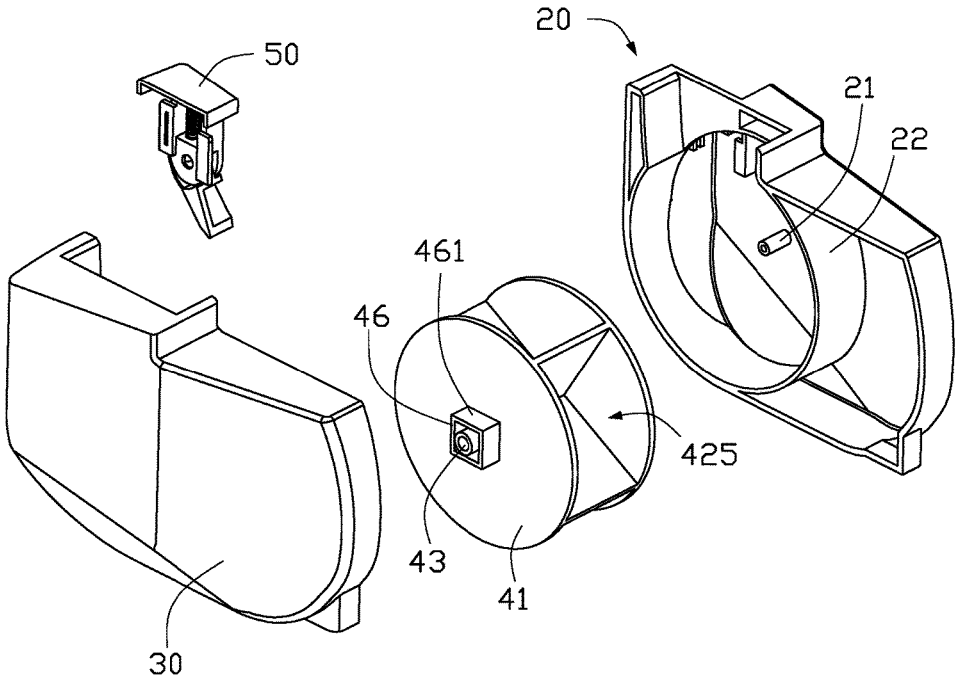
FIG. 2 is similar to FIG. 1, but viewed from a different angle.

FIG. 1 and FIG. 2 illustrate that the case 10 can include a first case body 20, a second case body 30 connected to the first case body 20, and a cover (not shown). A top of the case 10 defines a picking opening 15 (shown as in FIG. 5) for loading and extracting the pills. The cover covers the picking opening 15. The first case body 20 and the second case body 30 cooperatively define a receiving space 25, and the rotating member 40 is received in the receiving space 25. The first case body 20 is secured to the second case body 30 by screws or hooks or adhesively.

A rotating shaft 21 and a ring wall 22 extend from an inner surface of the first case body 20. The ring wall 22 is substantially circular with the rotating shaft 21 as a center of that circle. The rotating member 40 is received within the ring wall 22. An installation portion 23 is located in the top portion of the first case body 20. The installation portion 23 defines a through hole 231 communicating with the receiving space 25. The pressing structure 50 is slideably installed in the installation portion and extends into the receiving space 25 through the through hole 231. The installation portion 23 can include two sidewalls 232 each defining a sliding slot 233 extending vertically. An installation plate 234 extends from one of the two sidewalls 232 towards the through hole 231. A positioning post 235 extends from the installation plate 234. The first case body 20 defines a window 24, through which the internal workings of the case 10 can be observed.

A rotating shaft 31 and a ring wall 32 extend from an inner surface of the second case body 30. The ring wall 32 is substantially circular with the rotating shaft 31 as a center of that circle. The rotating member 40 is received within the ring wall 32. Two driving modules 35 are located in the ring wall 32. Each driving module 35 can include a mounting member 36 secured to an inner surface of the second case body 30 and a driving member 37 mounted in the mounting member 36. The mounting member 36 can include two mounting blocks 365 (shown in FIG. 7). A gap is defined between the two mounting blocks 365. The driving member 37 is capable of being inserted into the gap so as to be mounted to the mounting member 36. Each driving member 37 can include a mounting piece 371 (shown in FIG. 7) and a driving piece 372 (shown in FIG. 7) perpendicularly connected to the mounting piece 371. The mounting piece 371 is inserted in the gap so as to be mounted to the mounting member 36. Each driving piece 372 is elastically deformable. The two driving pieces 372 are substantially parallel to each other.

FIG. 1 and FIG. 2 further illustrate that the rotating member 40 can include two rotating plates 41 parallel to each other and a plurality of partitions 42 located between the two rotating plates 41. Each two adjacent partitions of the plurality of partitions 42 are perpendicularly connected to each other and define a plurality of pill grips 425. Each pill grip 425 is configured to receive different number of pills or different type of pills. A size of the picking opening 15 is substantially equal to a size of each pill grip 425. A sleeve 43 and a ratchet wheel 44 extend outwards from an outer surface of each rotating plate 41. The sleeve 43 is located within the ratchet wheel 44, and the ratchet 44 includes four ratchets 441 each having a blocking surface 446. The rotating plates 41 have a plurality of tags 45, each tag 45 is readable, and each tag 45 corresponds to one of the pill grips 425. In at least one embodiment, the tags 45 can display "morning", "noon", "afternoon", and "before sleep" respectively. A rotating block 46 extends from an outer surface of another rotating plate 46 and surrounds the sleeve 43. The rotating block 46 is substantially a square and includes four rotating pieces 461. The driving piece 372 can abut each of the rotating pieces 461.

Figure 3:
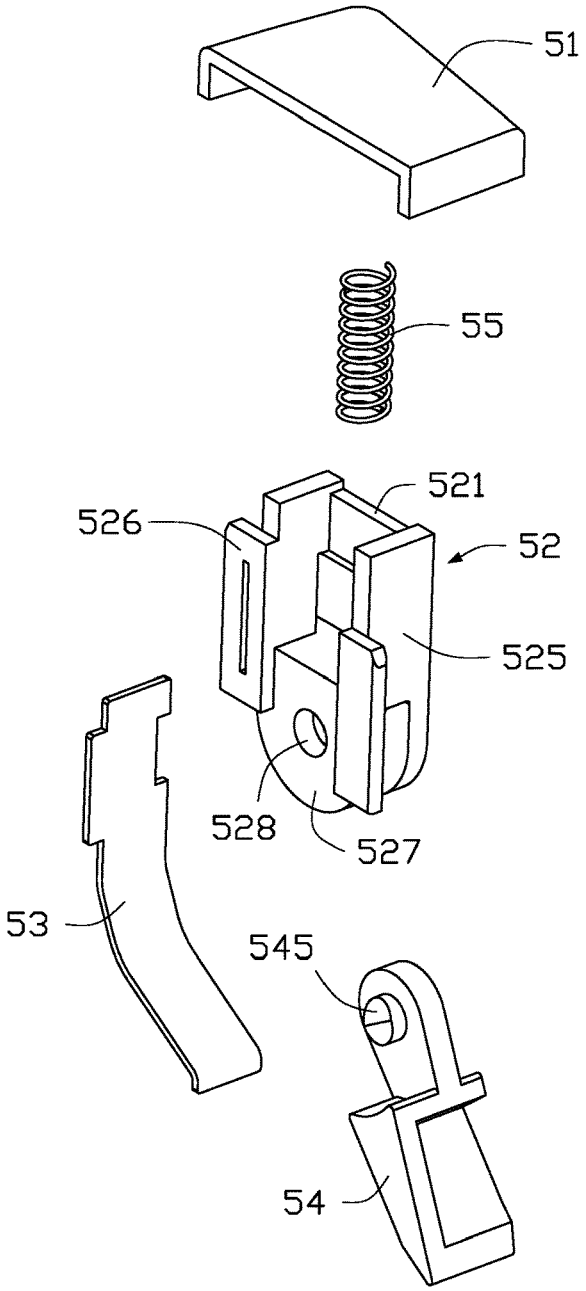
FIG. 3 is an exploded, isometric view of a pressing structure of the pill box of FIG. 1.
Figure 4:
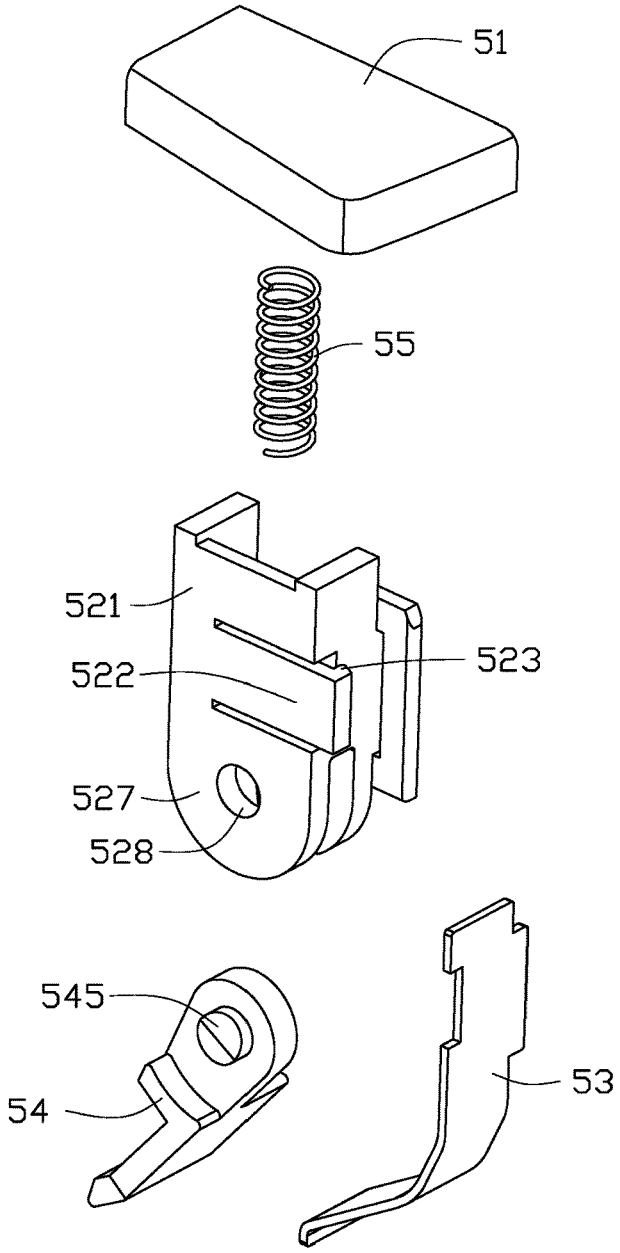
FIG. 4 is similar to FIG. 3, but viewed from a different angle.

FIG. 3 and FIG. 4 illustrate that the pressing structure 50 can include a pressing plate 51, a sliding member 52, a pushing plate 53, a pawl 54, and a resilient member 55.

The sliding member 52 can include a bottom plate 521 and two side plates 525 extending perpendicularly from opposite sides of the bottom plate 521. A latching plate 522 extends from the bottom plate 521 and a latching block 523 extends from an end of the latching plate 522. The latching block 523 is configured to latch the pushing member 53 to one of the two side plates 525. A sliding plate 526 extends from an edge of each side plate 525 substantially parallel to the bottom plate 521. The sliding member 52 further includes two connecting plates 527 connected to the bottom plate 521 and the two side plates 525. Each connecting plate 527 defines a pivoting hole 528 for mounting the pawl 54.

The pushing plate 53 abuts one of the two side plates 525 and with a first end latched between the latching plate 522 and the sliding plate 526 by the latching block 523. A second end of the pushing plate 53 is curved to abut the pawl 54. Two pivoting shafts 545 extend from the pawl 54 and are configured to be inserted into the pivoting holes 528 to pivotably mount a first end of the pawl 54 in the sliding member 52. A second end of the pawl 54 can abut the ratchet wheels 44 and can push the ratchet wheels 44 to rotate. A first end of the resilient member 55 is secured to the positioning post 235, and a second end of the resilient member 55 abuts the pressing plate 51.

Figure 5:
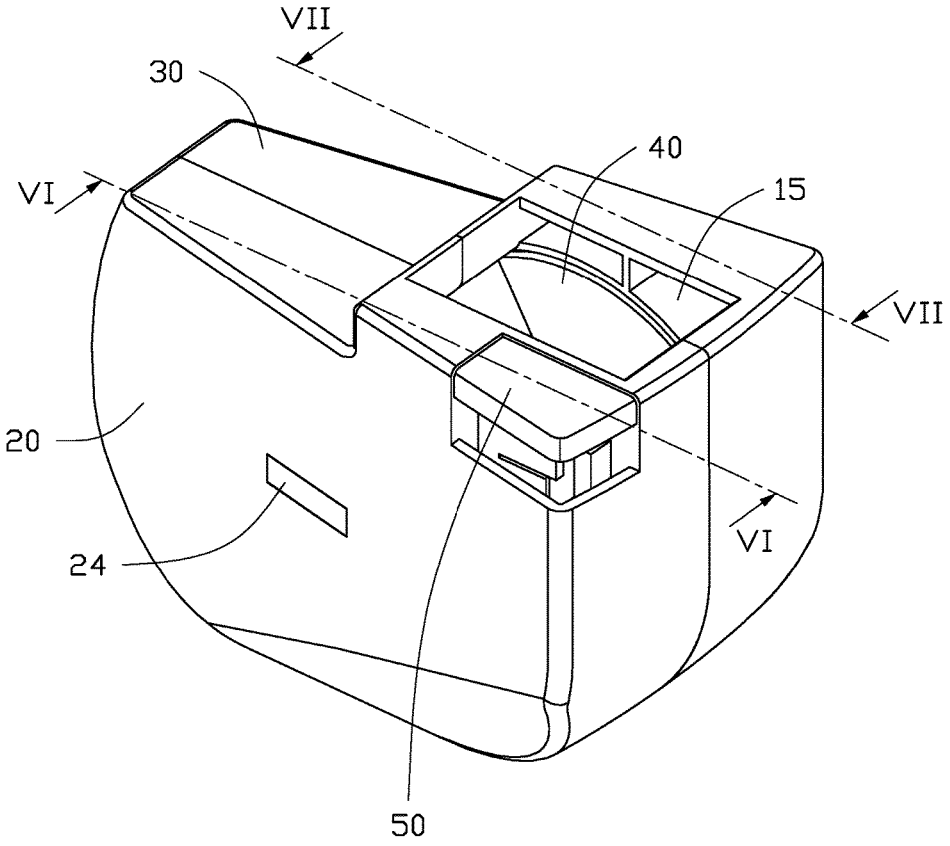
FIG. 5 is an assembled, isometric view of the pill box of FIG. 1.
Figure 6:
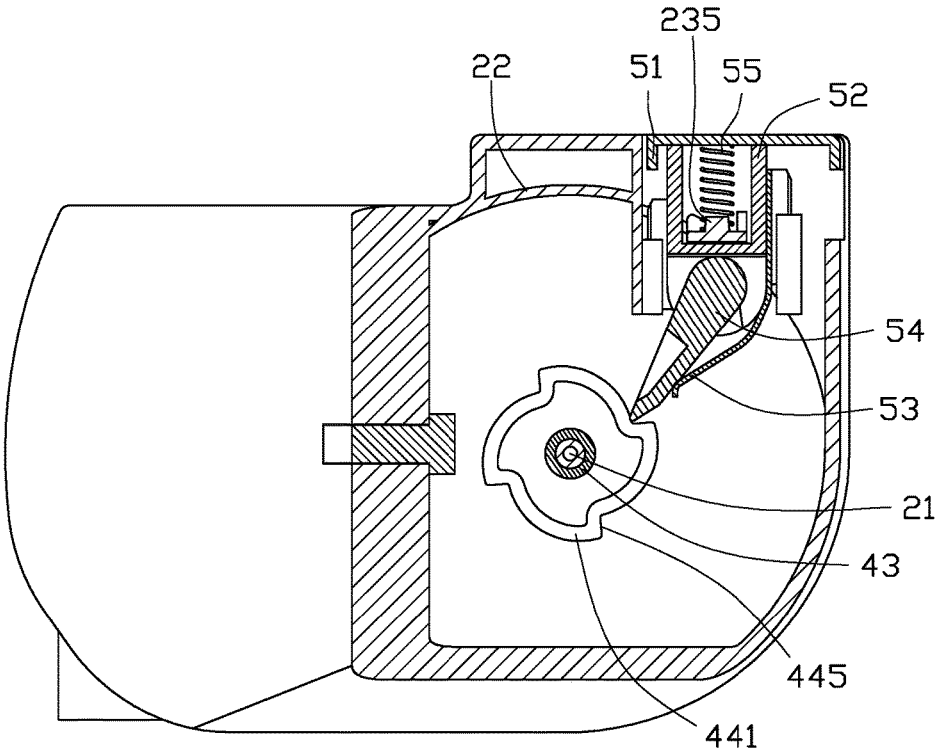
FIG. 6 is a cross-sectional view of the pill box of FIG. 5, taken along a line VI-VI.
Figure 7:
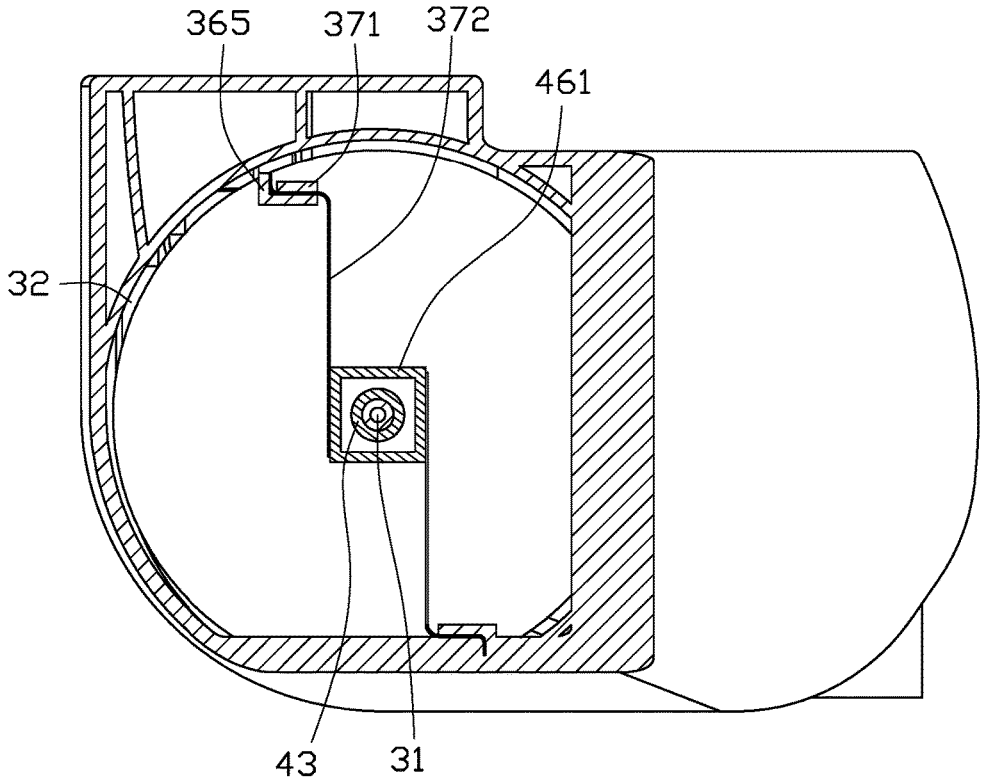
FIG. 7 is a cross-sectional view of the pill box of FIG. 5, taken along a line VII-VII.

FIGS. 5-7 illustrate that in assembly of the pill box 100, the rotating member 40 is placed between the first case body 20 and the second case body 30 so as to be closely received in the ring walls 22 and 32. The rotating shafts 21 and 31 are inserted into the sleeves 43 to rotatably mount the rotating member 40 to the case 10. The driving piece 372 abuts the rotating piece 461.

The pressing plate 51 is mounted to the top portion of the sliding member 52. The pivoting shaft 545 is inserted into the pivoting hole to rotatably install the ratchet wheel 54 to the sliding member 52. The pushing plate 53 abuts one of the two side plates 525 with the first end latched between the latching plate 522 and the sliding plate 526 by the latching block 523. The second end of the pushing plate 53 abuts the pawl 54. The pressing structure 50 is placed in the installation portion 23, and the ratchet wheel 54 and the pushing plate 53 extend through the through hole 231 to be received in the receiving space 25. The pawl 54 abuts the blocking surface 445. The sliding plate 526 is inserted into the sliding slot 233 to slidably install the sliding member 52 to the first case body 20. The installation plate 234 abuts the connecting plate 527 to prevent the sliding member 52 from disengaging from the first case body 20. The resilient member 55 abuts the positioning post 235 and the pressing plate 51. The first case body 20 is secured to the second case body 20 with the cover covering the picking opening 15. The pill box 100 is thus assembled.

Figure 8:
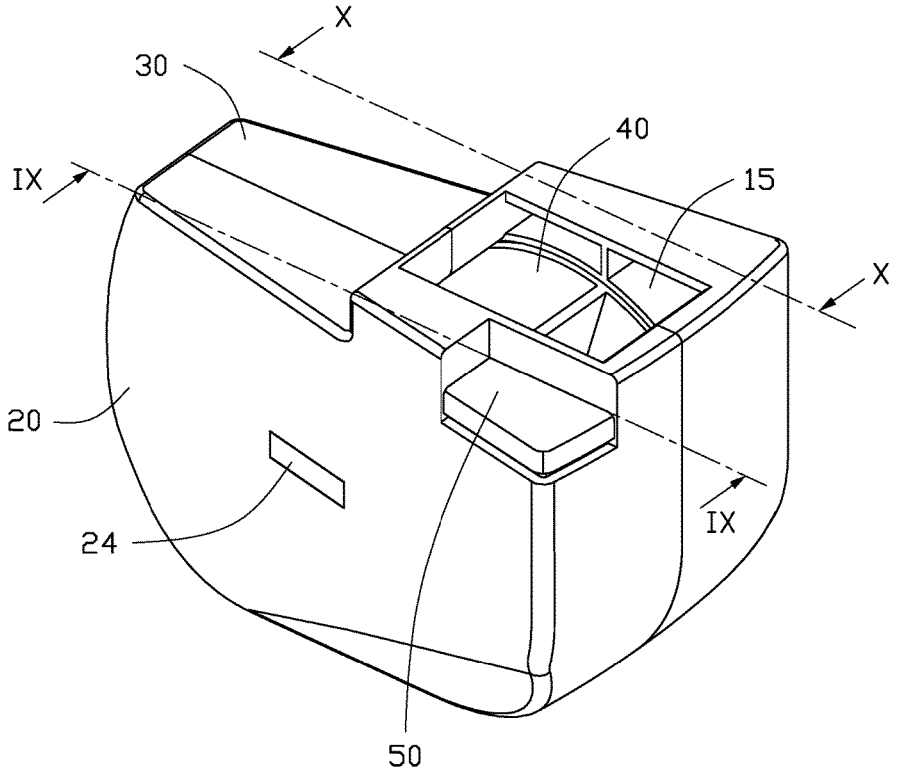
FIG. 8 is similar to FIG. 5, but viewed from a different angle.
Figure 9:
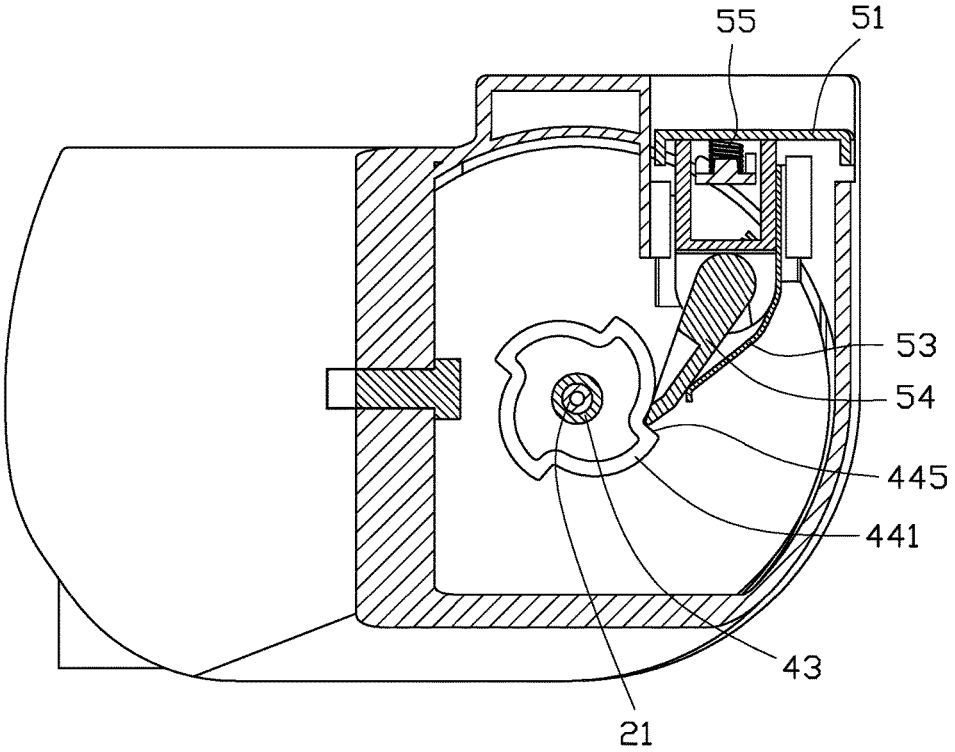
FIG. 9 is a cross-sectional view of the pill box of FIG. 8, taken along a line IX-IX.
Figure 10:
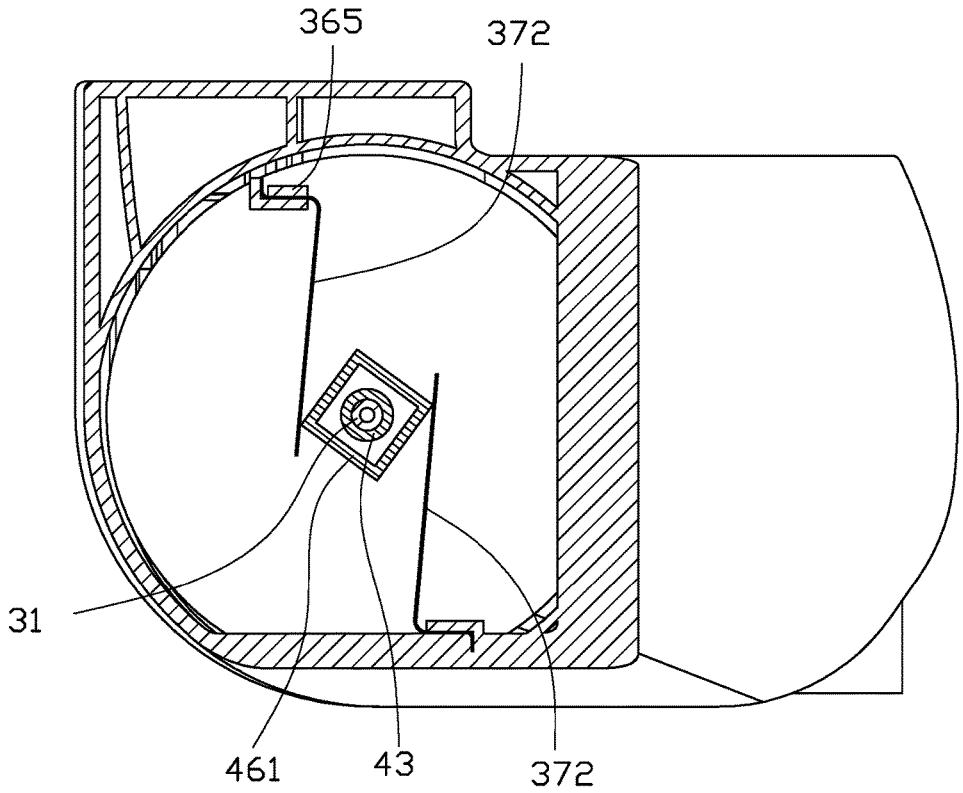
FIG. 10 is a cross-sectional view of the pill box of FIG. 8, taken along a line X-X.

FIGS. 8-10 illustrate that when taking the pill carried in the pill grip 425 out of the pill box 100, the pressing plate 51 is pressed to slide the sliding member 52 downward in the sliding slot 233 together with the ratchet wheel 54. The ratchet wheel 54 abuts the blocking surface 446 to rotate the rotating member 40. The rotating block 46 pushes past the driving piece 372 to elastically deform the two driving pieces 372 outwards. When the rotating block 46 is just after being diagonal to the two driving pieces 372, the two driving pieces 372 rebound to force the rotating member 40 to further rotate until the rotating block 46 abuts another pair of rotating pieces 461. In this position, one pill grip 425 is aligned with the picking opening 15, and the pill or pills in the pill grip 425 can be taken out by opening the cover.

In at least one embodiment, the user can place different pills in different pill grips 425. When the user wants the morning pill, the user can check the display of the tag 45 through the window 24, if "morning" is displayed, the user can take the pill out directly; if not, the user can repeat his press on the pressing plate 51 until the display of the tag 45 shows the correct label, and then take out the correct pill.

The embodiments shown and described above are only examples. Many details are often found in the art such as the other features of a pill box. Therefore, many such details are neither shown nor described. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A pill box, comprising:

a case defining a picking opening;

a rotating member rotatably mounted in the case and comprising a ratchet wheel and a plurality of pill grips each configured to receive pills; and a pressing structure comprising a sliding member slidably mounted to the case and a pawl abutting the ratchet wheel; wherein the pressing structure further comprises a pushing plate, a first end of the pushing plate being secured to the sliding member;

wherein the sliding member is slidable relative to the case to slide the pawl, the pawl resists the ratchet wheel to rotate the ratchet wheel to align one of the plurality of pill grips with the picking opening; and wherein the sliding member further comprises two connecting plates, and each connecting plate defines a pivoting hole; the pressing structure further comprises two pivoting shafts extending from the pawl; and the two pivoting shafts are rotatably inserted in the pivoting holes of the two connecting plates.

2. The pill box of claim 1, wherein the ratchet wheel comprises a plurality of ratchets, each ratchet has a blocking surface, and the pawl abuts the blocking surface to push the ratchet wheel to rotate.

3. The pill box of claim 1, wherein the case comprises a first case body, a second case body secured to the first case body, and a rotating shaft extending from each of the first case body and the second case body; a sleeve extends from each of opposite of the rotating member; and the rotating shaft is inserted into the sleeve to rotatably mount the rotating member in the case.

4. The pill box of claim 3, wherein the first case body comprises an installation portion, and the installation portion defines two sliding slots; the sliding member comprises two sliding plates; and the two sliding plates are slidably engaged in the two sliding slot.

5. The pill box of claim 1, wherein the rotating member further comprises a rotating block, the case further comprises two driving members, and each driving member elastically abuts the rotating block.

6. The pill box of claim 5, wherein the rotating block is substantially a square and comprises four rotating pieces, each driving member comprises a driving piece, and the two driving pieces abut a pair of opposite two rotating pieces.

7. The pill box of claim 6, wherein the case further comprises a window, the rotating member comprises a plurality of tags, a number of the plurality of tags is equal to a number of the plurality of pill grips, and the plurality of tags is configured to display pill information for a user through the window.

8. The pill box of claim 1, wherein a second end of the pushing plate is elastically abutting the pawl to prevent the pawl from being disengaged from the pawl.

9. The pill box of claim 8, wherein the sliding member further comprises a bottom plate, a latching plate extending from the bottom plate, and a latching block extending from the latching plate, and the pushing plate is latched between the latching plate and one of the two sliding plates by the latching block.

10. A pill box, comprising:

a case defining a picking opening and a window;

a rotating member rotatably mounted in the case and comprising a ratchet wheel, a plurality of pill grips each configured to receive pills, and a plurality of tags corresponding to the plurality of pill grips; and a pressing structure comprising a sliding member slidably mounted to the case and a pawl abutting the ratchet wheel; wherein the pressing structure further comprises a pushing plate, a first end of the pushing plate being secured to the sliding member;

wherein the sliding member is slidable relative to the case to slide the pawl, the pawl resists the ratchet wheel to rotate the ratchet wheel to align one of the plurality of pill grips with the picking opening, and a corresponding tag is aligned with the window for a user to identify the pill in the one of the plurality of pill grips; and wherein the sliding member further comprises two connecting plates, and each connecting plate defines a pivoting hole; the pressing structure further comprises two pivoting shafts extending from the pawl; and the two pivoting shafts are rotatably inserted in the pivoting holes of the two connecting plates.

11. The pill box of claim 10, wherein the ratchet wheel comprises a plurality of ratchets, each ratchet has a blocking surface, and the pawl abuts the blocking surface to push the ratchet wheel to rotate.

12. The pill box of claim 10, wherein the case comprises a first case body, a second case body secured to the first case body, and a rotating shaft extending from each of the first case body and the second case body; a sleeve extends from each of opposite of the rotating member; and the rotating shaft is inserted into the sleeve to rotatably mount the rotating member in the case.

13. The pill box of claim 12, wherein the first case body comprises an installation portion, and the installation portion defines two sliding slots; the sliding member comprises two sliding plates; and the two sliding plates are slidably engaged in the two sliding slot.

14. The pill box of claim 10, wherein a second end of the pushing plate is elastically abutting the pawl to prevent the pawl from being disengaged from the pawl.

15. The pill box of claim 14, wherein the sliding member further comprises a bottom plate, a latching plate extending from the bottom plate, and a latching block extending from the latching plate, and the pushing plate is latched between the latching plate and one of the two sliding plates by the latching block.

16. The pill box of claim 10, wherein the rotating member further comprises a rotating block, the case further comprises two driving members, and each driving member elastically abuts the rotating block.

17. The pill box of claim 16, wherein the rotating block is substantially a square and comprises four rotating pieces, each driving member comprises a driving piece, and the two driving pieces abut a pair of opposite two rotating pieces.

18. The pill box of claim 17, wherein the two driving pieces are substantially parallel to each other.

* * * * *